US005721521A

United States Patent [19]

Drabeck et al.

[11] Patent Number: 5,721,521

[45] Date of Patent: Feb. 24, 1998

[54] NOTCH-ENHANCEMENT IN BAND-REJECT FILTERS

[75] Inventors: Lawrence Milton Drabeck, Long Branch Township, Monmouth County; Martin Victor Schneider, Holmdel Township, Monmouth County; Cuong Tran, Howell Township, Monmouth County, all of N.J.

[73] Assignee: Lucent Technologies Inc., Murray Hill, N.J.

[21] Appl. No.: 695,153

[22] Filed: Aug. 5, 1996

[51] Int. Cl.[6] ..... H01P 1/20

[52] U.S. Cl. ..... 333/202; 333/176

[58] Field of Search ..... 333/175, 176, 333/202

[56] References Cited

U.S. PATENT DOCUMENTS

| | | | |
|---|---|---|---|
| 4,207,547 | 6/1980 | Buck | 333/202 X |
| 4,460,879 | 7/1984 | Hirose | 333/176 X |
| 4,731,587 | 3/1988 | Jensen | 333/176 X |
| 5,132,651 | 7/1992 | Ishikawa et al. | 333/202 |
| 5,317,289 | 5/1994 | Konishi et al. | 333/17.1 |

*Primary Examiner*—Robert Pascal
*Assistant Examiner*—Barbara Summons

[57] ABSTRACT

A band-reject filter includes a three port circulator having an input port, a second port connected to a bandpass filter terminated in a matched load, and a third output port. The loss of the band-reject filter is enhanced by controlling the amplitude and phase of a feed-forward signal, passing between the input port and output port, relative to the amplitude and phase of a reflected signal from the matched load.

11 Claims, 2 Drawing Sheets

NOTCH-ENHANCEMENT IN BAND-REJECT FILTERS

FIELD OF THE INVENTION

The invention relates to band-reject filters and, more particularly, to a circuit for providing notch-enhancement in such band-reject filters.

BACKGROUND OF THE INVENTION

Receive and transmit circuits in base stations and hand sets of wireless communications systems require bandpass and band-reject filters for selecting or rejecting specific frequency bands. For example, the frequency bands that are either received or transmitted in the cellular 800 mega hertz (MHz) range are shown in FIG. 1.

In addition to rejecting specific limited band ranges, such as bands B or A' in FIG. 1, strong interference signals must be excluded or nulled out by enhancing the performance of conventional band-reject filters at certain frequencies. A typical example, are interfering signals generated by Special Mobile Radio (SMR) service providers at 850 MHz and other undesired carriers adjacent to the emerging Personal Communication System (PCS) bands.

An example of a prior art band-reject filter is shown in FIG. 2. Such a band-reject filter is widely used in satellite communications systems, specifically in satellite uplink earth stations and on the intelsat satellite. It's advantage is that band pass filters are easier to design and construct than equivalent band-reject filters which cover the same frequency range.

Undesirably, in many cellular base station and handset applications the interference rejection characteristics of these prior art band-reject filters are inadequate.

SUMMARY OF THE INVENTION

In accordance with the present invention, a notch-enhancement band-reject filter is implemented using a band-reject filter including a three port circulator having a first input port, a second input port connected to a bandpass filter terminated in a matched load and a third output port which further includes a phase shifting means for controlling the phase of a feed-forward signal ($I_{31}$), passing from the input port to the output port, relative to the phase of a reflected signal ($S_{11}$) from the matched load. In one embodiment a phase shifting means is connected between the bandpass filter and the second port to change the phase of the reflected signal from the bandpass filter.

In another embodiment, a phase shifting means is connected between the input port and the output port to change the phase of the feed-forward signal.

In yet another embodiment, a signal coupling circuit is included which couples a predetermined amount of signal ($I_{31A}$) between the input port and the output port such that when it is added to the amplitude of the feed-forward signal ($I_{31}$) the combined signal equals the amplitude but is opposite in phase to the reflected signal ($S_{11}$).

DETAILED DESCRIPTION

Figure 1:
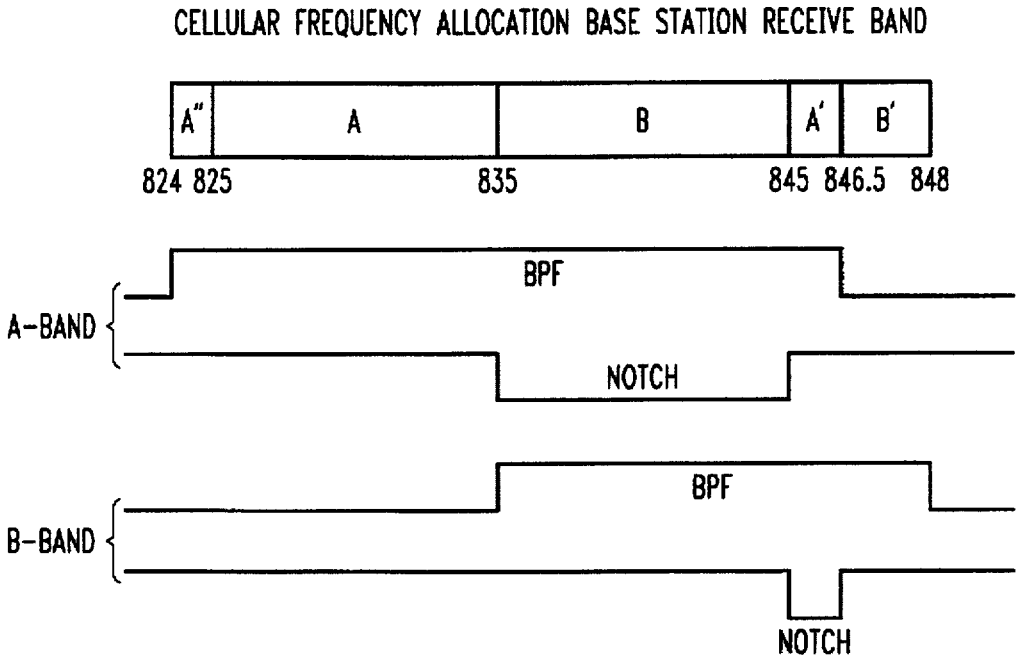
FIG. 1 shows the cellular frequency allocation of the base station receive band.
Figure 4:
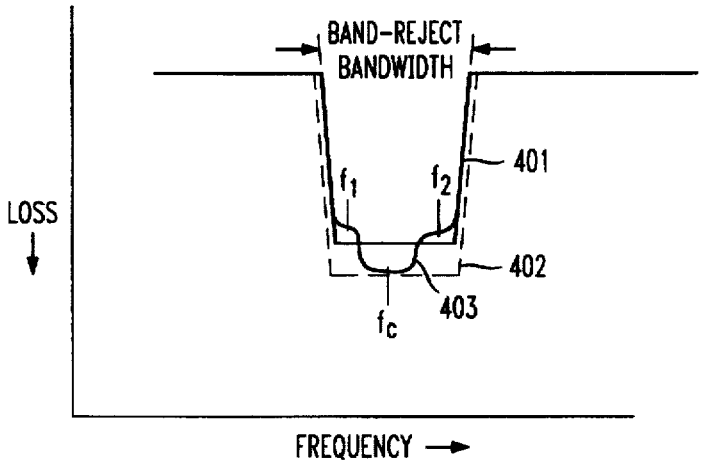
FIG. 4 shows the resulting loss characteristic of the notch-enhancement band-reject filter of FIG. 3.

With reference to FIG. 1, the cellular frequency allocation for base station receive bands is 824 MHz to 849 MHz. The specific band ranges B and A' are rejected by using notch filters as indicated. With reference to FIG. 4, the prior art band-reject filters exhibit the illustrative notch filter (or band-rejection filter) characteristics shown by the curve 401. When enhanced rejection loss is desired, it often comes at the cost of an increase in the bandwidth of the notch, as shown illustratively by the curve 402. As will be discussed more in later paragraphs and as shown by the curve 403, the present invention selectively increases the loss in a selected sub-band portion of the rejection band (around the frequency $f_c$, where strong interference signals exist) without significantly affecting the overall bandwidth of the notch filter. Typical examples of the interfering signals are those generated by Special Mobile Radio (SMR) service providers (e.g., at 850 MHz) and those generated by other undesired carriers adjacent to the emerging Personal Communications Services (PCS) bands.

Figure 2:
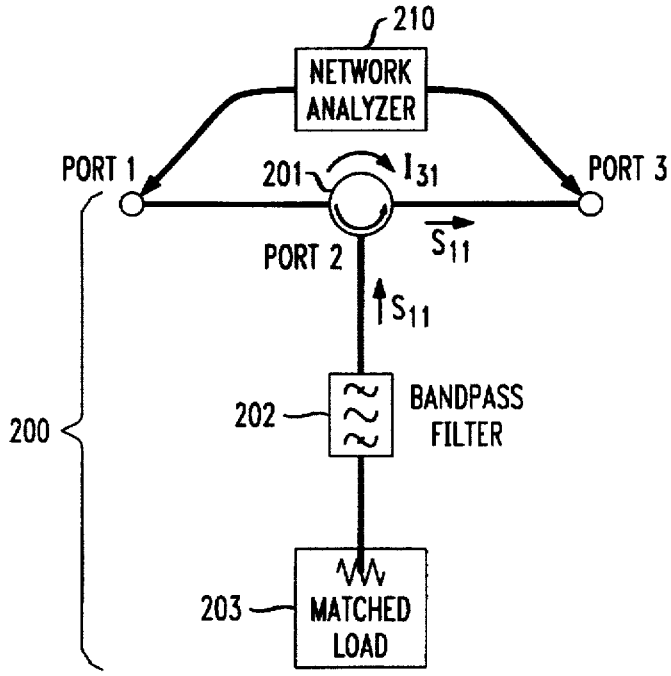
FIG. 2 PRIOR ART
FIG. 2 shows a prior art band-reject filter.

We have recognized that the rejection of the band-reject filter 200 shown in FIG. 2 is limited by the absolute value of $S_{11}$, or more specifically—$\log|S_{11}|$.

With reference to FIG. 2, we briefly describe the operation of a prior art band-reject filter 200. As shown, the band-reject filter 200 includes a three port circulator 201 having a first port which serves as an input port, a second port which serves to connect to a bandpass filter 202 to which is connected a matched load 203. The third port of circulator 201 serves as an output port.

The impedance of the matched load 203, or more specifically, a band-limited matched load, is tuned to match the port impedance of bandpass filter 202. At the cellular frequencies of interest, the matched load is typically about 50 ohms to match the port impedance of bandpass filter 202. When the load impedance is properly matched or tuned to the center frequency of the bandpass filter 202, the reflection coefficient signal $S_{11}$ (also referred to herein as a scattering coefficient) of the bandpass filter 202 is minimized. The scattering coefficient signal $S_{11}$ determines the rejection characteristics of band-reject filter 200. The amount of the rejection is equal to the absolute value of the scattering coefficient signal $S_{11}$ more specifically,—$\log|S_{11}|$.

The value of the scattering coefficient signal $S_{11}$ may be determined using a network analyzer 210 connected between the input and output ports of the band-reject filter 200. The network analyzer 210 may be a frequency scanned gain/loss and phase measuring device. As connected, the network analyzer 210 measures the signal loss between the input port and the output port, i.e., the absolute value of scattering coefficient signal $S_{11}$, as well as the phase shift between the input signal and the scattered signal appearing at the output port of bandpass filter 202.

With reference to FIG. 2 and in accordance with the present invention, we have determined how to enhance the rejection of the band-reject filter 202, by taking advantage of the finite feed-forward isolation signal $I_{31}$ between input port (port 1) and output port (port 3) of circulator 201. The finite isolation signal $I_{31}$ is a small feed-forward signal which adds to or subtracts from the reflected signal $S_{11}$. The total signal appearing at output port 3 depends on the amplitude and phase of the two components $I_{31}$ and $S_{11}$. As will be discussed in a later paragraph, if the amplitude of the signals $I_{31}$ and $S_{11}$ can be made equal and opposite in phase, signal cancellation will result thereby reducing the amplitude of the total signal at the output port of the band-reject filter.

The isolation signal $I_{31}$ for conventional, commercially available circulators 201 can be in the range from −20 dB to −30 dB. The exact value of isolation $I_{31}$ is determined by the geometrical configuration and topology of the isolator 201 assembly. The isolation signal $I_{31}$ can be readily tuned or trimmed by the manufacturer to a given value, for example −27 dB for the specified frequency range of the circulator. Thus, the total signal $I_{31}+S_{11}$ at a given frequency can be minimized or nulled to achieve notch-enhancement of the band-reject filter 200. Technical details on circulator performance and particularly on achievable isolation signal $I_{31}$ values may be obtained from any commercial manufacturers of isolators, such as Mica Microwave Corporation located in San Jose. Calif. Other manufacturers of such isolators include K W Microwave Corporation of Carlsbad, Calif. and Ocean Microwave Corporation of Neptune, N.J.

Figure 3:
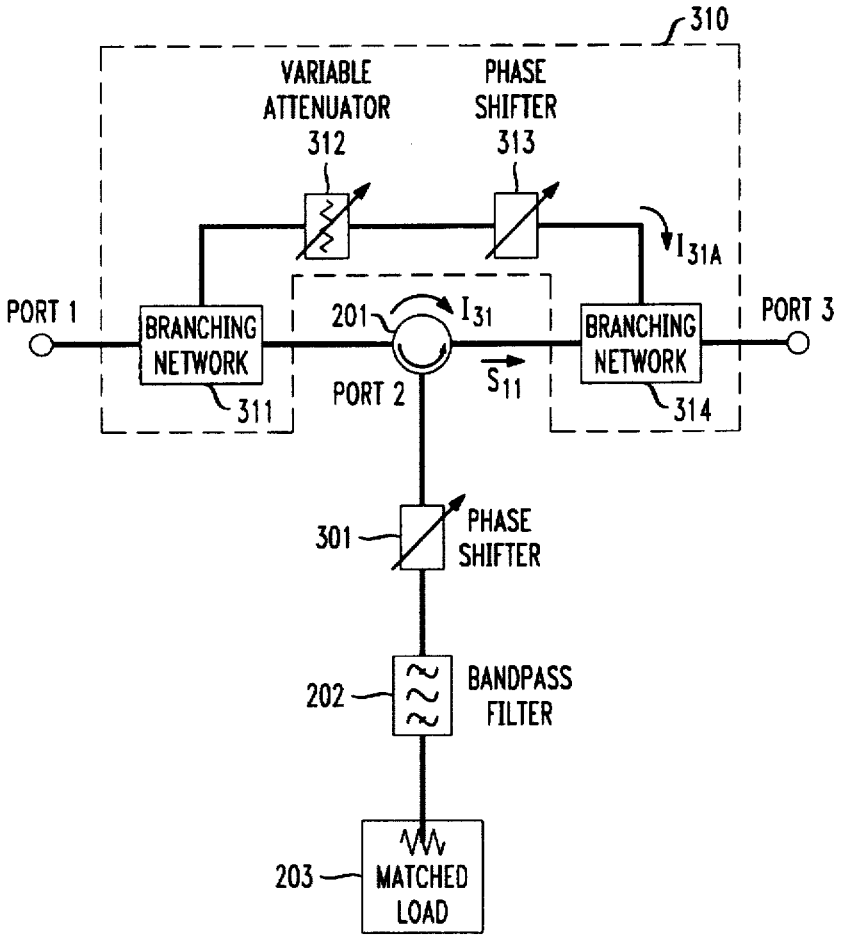
FIG. 3 shows a notch-enhancement band-reject filter in accordance with the present invention.

According to one aspect of our invention shown in FIG. 3, a phase shifter 301 is added between port 2 of isolator 201 and a port of bandpass filter 202. It should be noted that the phase shifter 301 may also be located between the other port of the bandpass filter 202 and matched load 203. In such an arrangement, the phase shifter 301 alters the phase of the scattering coefficient $S_{11}$. Advantageously, if the delay of the phase shifter 301 is bidirectional it acts to change the phase of both the signal exiting port 2 and entering bandpass filter 202 as well as change the phase of the reflected signal $S_{11}$exiting bandpass filter 202 and re-entering port 2. Thus, if the phase shifter 301 has equal phase delay characteristics in both directions (e.g., such as a line stretcher or an additional length of transmission line) the resulting phase shift will be twice as much. Thus, phase shifter 301 need only have half of the desired phase shift needed to be added to the reflected signal $S_{11}$.

According to another embodiment, a portion of the input signal is coupled around the circulator 201 from port 1 to port 3 using a coupling circuit 310 to provide an additional feed forward signal $I_{31A}$. The coupling circuit 310 consists of a branching network 311 which extracts a portion of the signal input to port 1. The signal $I_{31A}$ has its amplitude and phase varied by the fixed or variable attenuator 312 and the phase shifter 313. Signal $I_{31A}$ is then recombined with $I_{31}$ and the signal from port 2 via another branching network 314. The variable attenuator 312 is optional and the desired signal amplitude can be adjusted by varying the amount of coupling from branching network 311 and 314. In this embodiment, phase shifter 301 is optional.

The phase shifters 301 and 313 may be implemented in any of a variety of ways including a line stretcher, an additional section of transmission line, or a passive or active circuit consisting of one or more lumped capacitors and/or inductors. The combined transfer characteristics of transfer circuit 310 would produce a feed-forward signal $I_{31A}$ having a predetermined amplitude and phase value.

The resulting or total signal at output port 3 is the sum of the reflected signal $S_{11}$ plus the isolation signal $I_{31}$ plus the feed-forward signal $I_{31A}$. This total or resulting signal may be determined as follows. In the following equation A represents the amplitude of the reflected signal $S_{11}$ and B represents the amplitude of the combined signal $I_{31}+I_{31A}$. The phase of reflected signal $S_{11}$ is represented by $\Phi_1$ and the phase of the combined signal is $\Phi_2$. The resulting signal amplitude at the output port 3 is referred to as $E_0$ and is equal to $$E_0=A \sin(\Phi_1)+B \sin(\Phi_2).$$

The signal power is proportional to $E_0^2$ or $$=(A \sin(\Phi_1)+B \sin(\Phi_2))^2$$

$$=A^2\sin^2(\Phi_1)+B^2\sin^2(\Phi_2)+2AB \sin(\Phi_1) \sin(\Phi_2)$$

By adjusting the phase of the reflected signal $S_{11}$ (i.e., $\Phi_1$ in our example) to be 180 degrees out of phase with the phase ($\Phi_2$) of the combined signal $I_{31}+I_{31A}$, signal cancellation occurs at output port 3. Since $$\sin(\Phi_1)=-\sin(\Phi_2)$$

Our equation reduces to $$=(A^2+B^2-2AB) \sin^2(\Phi_1)$$

The scattering (S) parameter of the transmitted signal from port 1 to port 3 ($S_{31}$) when $\Phi_1$ and $\Phi_2$ are 180 degrees out of phase is proportional to $$S_{31} \propto (A^2+B^2-2AB)^{1/2}$$

Additionally, if the magnitude of $I_{31}+I_{31A}$(i.e., B) is made equal to the magnitude of $S_{11}$(i.e., A), then in the above equation, the combined signal power at the output port 3 can ideally become zero.

In practical circuits, it may not be likely to achieve a $S_{31}=0$, however, $|S_{31}|$ can be minimized by this procedure. Moreover, if the phases $\Phi_1$and $\Phi_2$ cannot be made 180 degrees out of phase, limited cancellation can be obtained for phase differences that are close to 180 degrees.

Additionally, in practical circuits, the cancellation between $S_{11}$ and $I_{31}+I_{31A}$ may not occur over all of the frequencies of the band-reject filter (shown by 403 of FIG. 4). In such a circumstance, cancellation may be maximized at the frequencies of interest, those frequencies which provide the most interference to the desired frequencies. Note in FIG. 4 that while enhanced frequency rejection exists, illustratively, at center frequency $f_c$, reduced frequency rejection typically exists at frequencies $f_1$and $f_2$. Thus the present invention provides enhanced rejection for a band of frequencies of interest without increasing the overall notch-bandwidth of the notch-reject filter 200.

What has been disclosed is merely illustrative of the present invention. Other arrangements can be implemented by those skilled in the art without departing from the spirit and scope of the present invention.

We claim:

1. A band-reject filter including a three port circulator having a first port, a second port connected to a bandpass filter terminated in a matched load, and a third output port, said filter further including:

Phase shifting means for controlling the phase of a feed-forward signal ($I_{31}$), passing from the input port to the output port, relative to the phase of a reflected signal ($S_{11}$) from the bandpass filter terminated by the matched load, the relative phase between the reflected signal and the feed-forward signal being controlled so as to produce signal cancellation between the feed-forward and the reflected signals at the output port.

2. The band-reject filter of claim 1 wherein the phase shifting means is a line stretcher which adds a predetermined phase delay in the signal path between the second port and the bandpass filter, said predetermined phase being sufficient to produce signal cancellation at the output port between the feed-forward and the reflected signals.

3. The band reject filter of claim 1 wherein the phase shifting means includes a circuit including a capacitive element.

4. The band reject filter of claim 1 wherein the phase shifting means includes circuit including an inductive element.

5. The band-reject filter of claim 1 where the phase shifting means shifts the phase of the reflected signal to be approximately 180 degrees out of phase with the feed-forward signal.

6. The band-reject filter of claim 1 wherein the phase shifting means is connected between the input port and the output port.

7. The band-reject filter of claim 1 wherein the phase shifting means produces a reflected signal at the output port which is approximately 180 degrees out of phase with the feed-forward signal for a selected signal band portion within a rejection band of the band-reject filter.

8. The band-reject filter of claim 7 wherein the phase shift means produces a reflected signal at the output port which does not cancel the feed-forward signal for frequencies within the rejection band but outside the selected signal band.

9. The band-reject filter of claim 1 further including a signal coupling circuit for coupling a predetermined signal from the first port to the third port and wherein the magnitude of the coupled signal ($I_{31A}$) together with the feedforward signal ($I_{31}$) at the output port is substantially equal to the magnitude of the reflected signal ($S_{11}$).

10. The band-reject filter of claim 9 wherein the signal coupling circuit includes a phase shifter.

11. The band-reject filter of claim 10 wherein the signal coupling circuit includes an attenuator means in series with the phase shifter.

* * * * *